US010050387B1

(12) United States Patent
Wu et al.

(10) Patent No.: US 10,050,387 B1
(45) Date of Patent: Aug. 14, 2018

(54) METHOD FOR MANUFACTURING SHIELDED CONNECTOR

(71) Applicant: LOTES CO., LTD, Keelung (TW)

(72) Inventors: Yong Quan Wu, Keelung (TW); Chien Hung Ho, Keelung (TW); You Hua Cai, Keelung (TW); Zuo Feng Jin, Keelung (TW); Chang Wei Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/869,636

(22) Filed: Jan. 12, 2018

(30) Foreign Application Priority Data

May 5, 2017 (CN) ..... 2017 1 0312819

(51) Int. Cl.

| | |
|---|---|
| ***H01R 9/03*** | (2006.01) |
| ***H01R 13/6591*** | (2011.01) |
| ***H01R 43/16*** | (2006.01) |
| ***H01R 43/20*** | (2006.01) |

(52) U.S. Cl.
CPC ..... *H01R 13/6591* (2013.01); *H01R 43/16* (2013.01); *H01R 43/20* (2013.01)

(58) Field of Classification Search
CPC ..... H01R 13/6591; H01R 43/20; H01R 43/16
USPC ..... 439/607.41
See application file for complete search history.

(56) References Cited

U.S. PATENT DOCUMENTS 4,153,988 A * 5/1979 Doo ..... H01L 23/642 29/827
2006/0220215 A1* 10/2006 Lee ..... H01L 21/84 257/691
2010/0144093 A1* 6/2010 Viswanadam ..... H01L 21/568 438/109

FOREIGN PATENT DOCUMENTS

CN 103647174 B 5/2016

* cited by examiner

*Primary Examiner* — Jean F Duverne
(74) *Attorney, Agent, or Firm* — Locke Lord LLP; Tim Tingkang Xia, Esq.

(57) ABSTRACT

A method for manufacturing a shielded connector includes: providing a body having an upper surface, a lower surface, a signal accommodating hole and a ground accommodating hole; plating a metal layer on the upper surface of the body and inner walls of the signal accommodating hole and the ground accommodating hole; forming an isolating region in the area around the signal accommodating hole to divide the metal layer into a first metal layer and a second metal layer; electrifying the first metal layer with an electroplating treatment so as to increase a thickness of the first metal layer, where the second metal layer is not thickened; partially removing the metal layer, so as to completely remove the second metal layer and decrease the thickness of the first metal layer; and installing a signal terminal and a ground terminal correspondingly in the signal accommodating hole and the ground accommodating hole, respectively.

19 Claims, 17 Drawing Sheets

100

100

METHOD FOR MANUFACTURING SHIELDED CONNECTOR

CROSS-REFERENCE TO RELATED APPLICATION

This non-provisional application claims priority to and the benefit of, pursuant to 35 U.S.C. § 119(a), Patent Application Serial No. 201710312819.5 filed in P.R. China on May 5, 2017, the entire content of which is hereby incorporated by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention relates to a method for manufacturing a shielded connector, and more particularly to a manufacturing method capable of ensuring a good shielding effect of the shielded connector.

BACKGROUND OF THE INVENTION

A shielded connector is disclosed in Chinese Patent No. CN201310691784.2, which comprises at least one body, where each of the bodies has an upper surface and a lower surface, and multiple signal accommodating grooves and multiple ground accommodating grooves run through the lower surface from the upper surface; during manufacturing, a conductive layer is arranged on the whole body in a plating way, so that the upper surface, the lower surface, the insides of the signal accommodating grooves and the insides of the ground accommodating grooves are provided with the conductive layer; then the conductive layer, adjacent to the periphery of each of the signal accommodating grooves, of the upper surface and the lower surface is etched away by an etching tool, so that the upper surface, adjacent to the periphery of each of the signal accommodating grooves, forms an isolating region, and the lower surface, adjacent to the periphery of each of the signal accommodating grooves, forms an insulating portion; the conductive layer inside the signal accommodating groove is also etched away to from an insulating surface, and the conductive layer inside the ground accommodating grooves is retained, so that only a ground terminal is in contact with the conductive layer, thereby ensuring a good shielding effect of the shielded connector.

However, the situation that the upper surface and the lower surface must be flat surfaces needs to be ensured in order to realize the above-mentioned etching process; when the upper surface and the lower surface are not flat surfaces, during the etching process, the upper surface and the lower surface are not flat, so that a gap still exists between the etching tool and the upper surface as well as the lower surface; during the etching process, an etching solution easily flows into a metal layer that we originally need to retain through the gap, and then the metal layer that we originally need to retain is also etched away, the manufacturing of the body is affected, and thereby the good shielding effect of the shielded connector is affected.

Therefore, a heretofore unaddressed need to design a new method for manufacturing a shielded connector exists in the art to address the aforementioned deficiencies and inadequacies.

SUMMARY OF THE INVENTION

An objective of the present invention is to provide a method for manufacturing a shielded connector, and more particularly to a manufacturing method capable of ensuring a good shielding effect of the shielded connector.

To achieve the foregoing objective, one aspect of the invention provides a method for manufacturing a shielded connector, the method including the following steps: S1: providing a body, having an upper surface and a lower surface which are oppositely arranged, and at least one signal accommodating hole and at least one ground accommodating hole respectively passing through the upper surface and the lower surface; S2: providing a metal layer, arranged on the upper surface of the body and inner walls of the at least one signal accommodating hole and the at least one ground accommodating hole in a plating way; S3: removing the metal layer in an area on the upper surface around the at least one signal accommodating hole by a laser, so as to form an isolating region in the area on the upper surface around the at least one signal accommodating hole, wherein the isolating region is not provided with the metal layer, and divides the metal layer into a first metal layer located outside the isolating region and a second metal layer located inside the isolating region; S4: electrifying the first metal layer on the upper surface for an electroplating treatment so as to increase a thickness of the first metal layer on the upper surface, wherein the second metal layer is electrically disconnected from the first metal layer and is not electrified, so that the second metal layer is not thickened; S5: removing a part of the metal layer by a thickness of the second metal layer, so as to completely remove the second metal layer and decrease the thickness of the first metal layer; and S6: providing at least one signal terminal and at least one ground terminal, wherein the at least one signal terminal and the at least one ground terminal are correspondingly installed in the at least one signal accommodating hole and the at least one ground accommodating hole, respectively, for conductively connecting to a chip module.

In certain embodiments, the body is further provided with a plurality of through holes around each of the at least one signal accommodating hole and each of the at least one ground accommodating hole respectively, the through holes pass through the upper surface and the lower surface, the isolating region is communicated with the at least one signal accommodating hole, and the through holes are located outside the isolating region.

In certain embodiments, the method further includes: after the step S6 is performed, arranging a supporting cover on the body for supporting the chip module, wherein: the supporting cover is provided with a plurality of through slots for the at least one signal terminal and the at least one ground terminal to pass therethrough respectively; a plurality of supporting blocks downwardly protrude from a bottom surface of the supporting cover; and when the chip module abuts the at least one signal terminal and the at least one ground terminal, the supporting blocks are supported on the upper surface and located between two adjacent through holes.

In certain embodiments, a plurality of protruding blocks are located on the upper surface for supporting the chip module; and in the step S2, the metal layer is also arranged on surfaces of the protruding blocks in the plating way.

In certain embodiments, the step S3 further comprises removing the metal layer in an area around the protruding blocks by the laser.

In certain embodiments, the step S3 further comprises removing the metal layer located at a joint area between the protruding blocks and the upper surface by the laser.

In certain embodiments, the step S3 further comprises removing the metal layer located in a surrounding area on side walls of the protruding blocks by the laser.

In certain embodiments, the step S3 further comprises removing the metal layer on top surfaces of the protruding blocks by the laser.

In certain embodiments, the protruding blocks comprise a first protruding block upwardly extending from the upper surface and a second protruding block located on the first protruding block, the top surface of the second protruding block is smaller than that of the first protruding block, and the top surface of the second protruding block is for supporting the chip module; and the step S3 further comprises removing the metal layer located on the top surface of the second protruding block by the laser.

In certain embodiments, a side wall upwardly protrudes from each of the four side edges of the upper surface for stopping the chip module from horizontally moving.

Another aspect of the invention provides a method for manufacturing a shielded connector, the method including the following steps: S1: providing a body, having an upper surface and a lower surface which are oppositely arranged, and at least one signal accommodating hole and at least one ground accommodating hole respectively passing through the upper surface and the lower surface; S2: providing a metal layer, arranged on the upper surface of the body and inner walls of the at least one signal accommodating hole and the at least one ground accommodating hole in a plating way; S3: removing the metal layer in an area on the upper surface around the at least one signal accommodating hole by a laser, so as to form an isolating region in the area on the upper surface around the at least one signal accommodating hole, wherein the isolating region is not provided with the metal layer; and S4: providing at least one signal terminal and at least one ground terminal, wherein the at least one signal terminal and the at least one ground terminal are correspondingly installed in the at least one signal accommodating hole and the at least one ground accommodating hole, respectively.

In certain embodiments, the body is further provided with a plurality of through holes around each of the at least one signal accommodating hole and each of the at least one ground accommodating hole respectively, the through holes pass through the upper surface and the lower surface, the isolating region is communicated with the at least one signal accommodating hole, and the through holes are located outside the isolating region.

In certain embodiments, the method further includes: after the step S6 is performed, arranging a supporting cover on the body for supporting the chip module, wherein: the supporting cover is provided with a plurality of through slots for the at least one signal terminal and the at least one ground terminal to pass therethrough respectively; a plurality of supporting blocks downwardly protrude from a bottom surface of the supporting cover; and when the chip module abuts the at least one signal terminal and the at least one ground terminal, the supporting blocks are supported on the upper surface and located between two adjacent through holes.

In certain embodiments, a plurality of protruding blocks are located on the upper surface for supporting the chip module; and in the step S2, the metal layer is also arranged on surfaces of the protruding blocks in the plating way.

In certain embodiments, the step S3 further comprises removing the metal layer on top surfaces of the protruding blocks by the laser.

In certain embodiments, the protruding blocks comprise a first protruding block upwardly extending from the upper surface and a second protruding block located on the first protruding block, the top surface of the second protruding block is smaller than that of the first protruding block, and the top surface of the second protruding block is for supporting the chip module; and the step S3 further comprises removing the metal layer located on the top surface of the second protruding block by the laser.

In certain embodiments, the top surface of the second protruding block is an arc-shaped surface.

In certain embodiments, the at least one ground terminal and the at least one signal terminal have same structures; and after step S4 is performed, the inner walls of the at least one signal accommodating hole and the at least one ground accommodating hole are both provided with the metal layer.

In certain embodiments, a side wall upwardly protrudes from each of the four side edges of the upper surface for stopping the chip module from horizontally moving.

Compared with the art, certain embodiments of the invention have the following beneficial advantages: the metal layer on the upper surface close to the periphery of the at least one signal accommodating hole is removed by the laser, so as to form an isolating region around the at least one signal accommodating hole, which can be realized without ensuring that the upper surface is a flat surface, thus facilitating the manufacturing of the body. The first metal layer is electrified for electroplating to increase its thickness, and the metal layer is partially removed by the thickness of the second metal layer, so that the second metal layer is completely removed and the body still has the first metal layer, thus ensuring the good shielding effect of the shielded connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
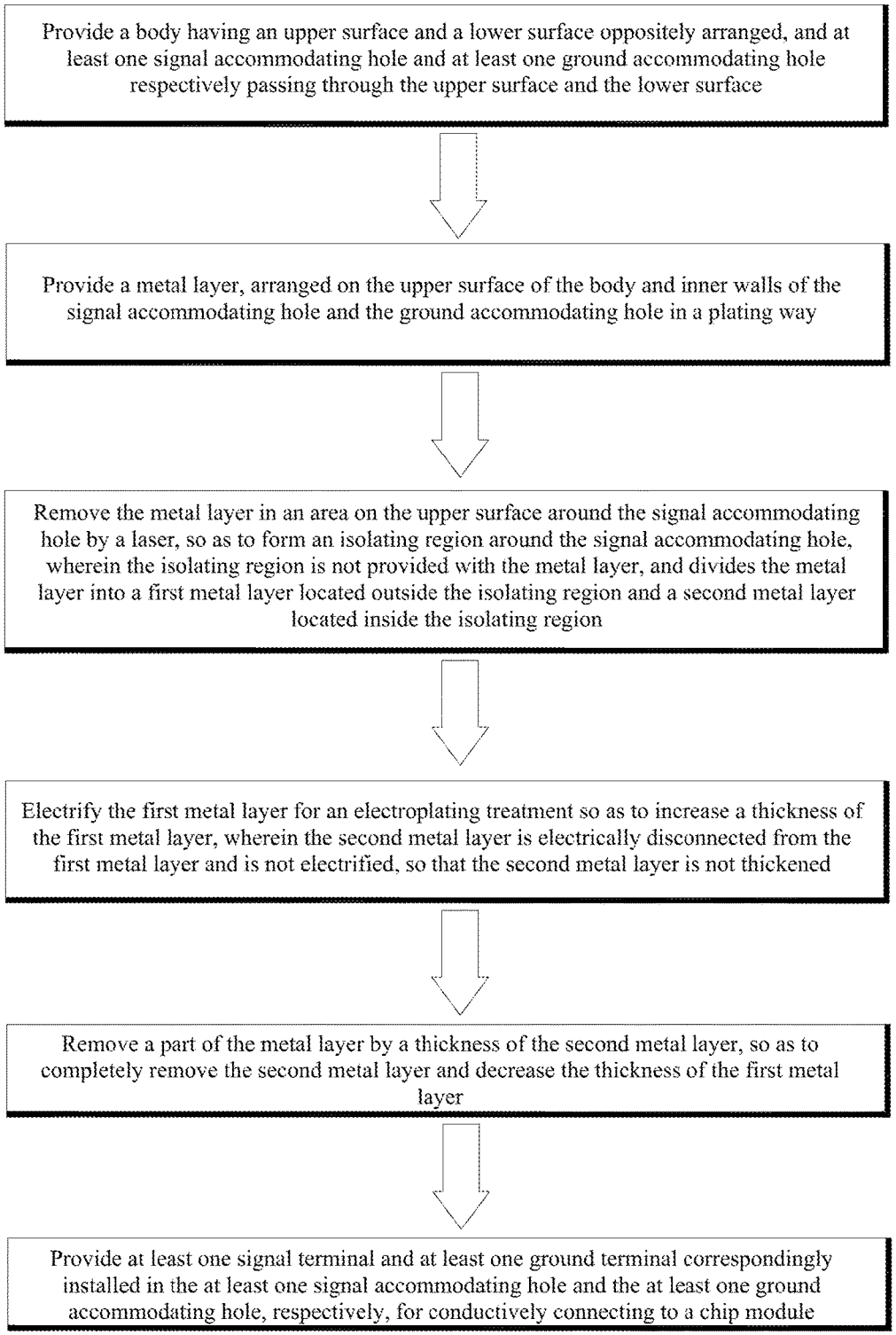
FIG. 1 is a flowchart of a method for manufacturing a shielded connector according to an embodiment of the present invention.
Figure 2:
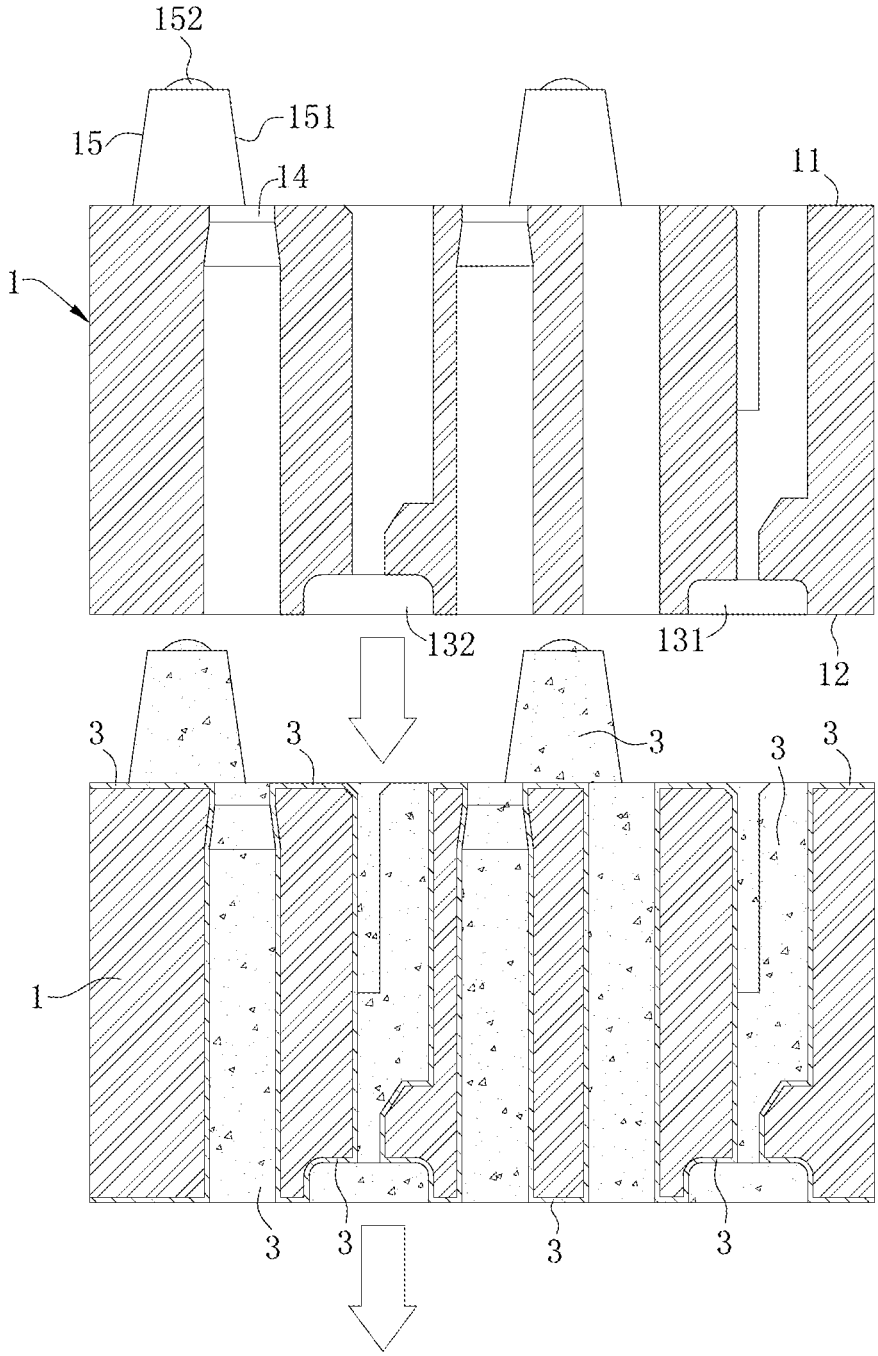
FIG. 2 is a structural schematic view of the shielded connector manufactured by the method in FIG. 1.
Figure 3:
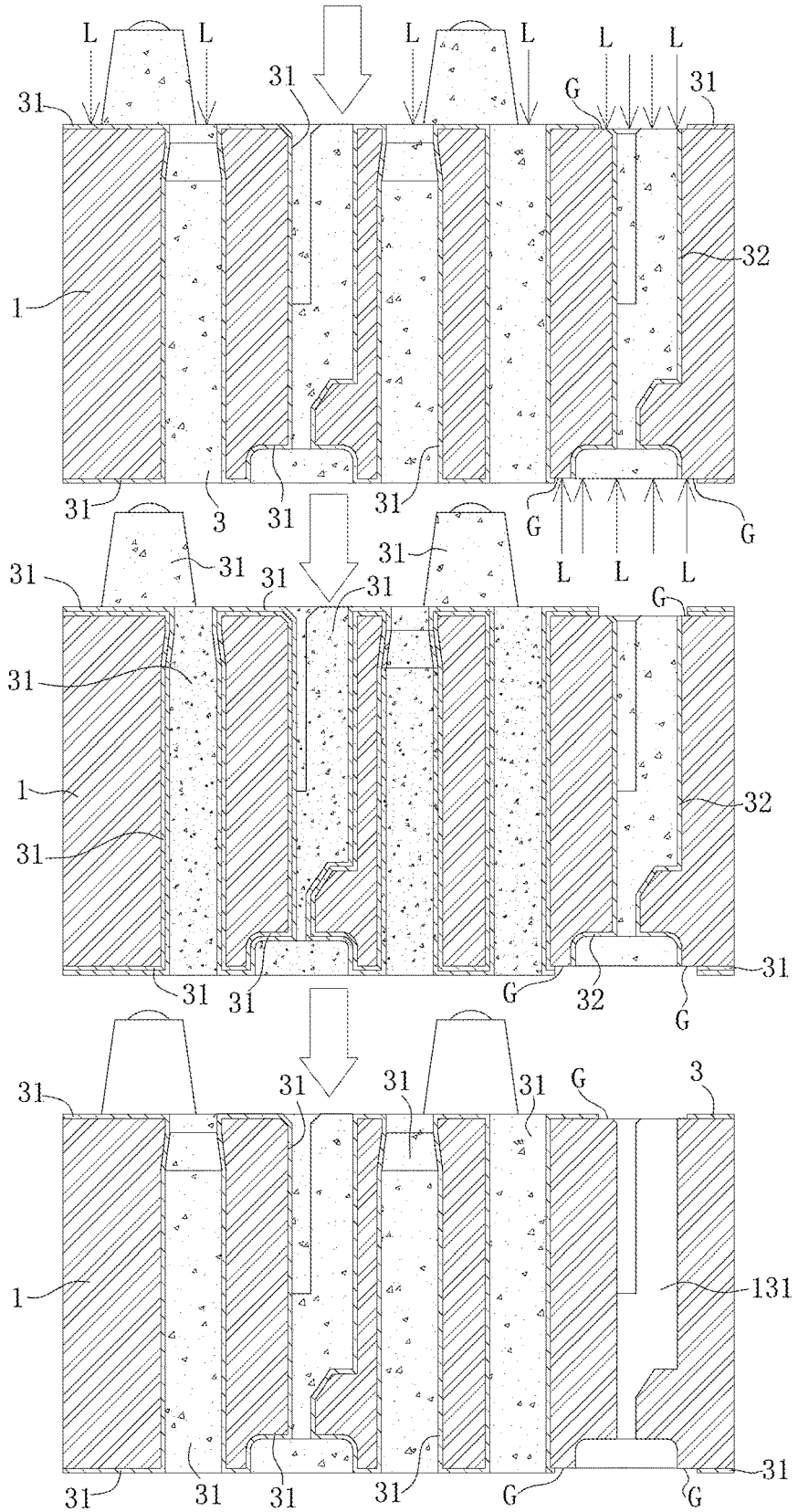
FIG. 3 is a structural schematic view of the shielded connector manufactured by the method in FIG. 1.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-17. In accordance with the purposes of this invention, as embodied and broadly described herein, this invention, in one aspect, relates to a method for manufacturing a shielded connector.

As shown in FIG. 1 to FIG. 10, a shielded connector 100 in a first embodiment of the present invention is used for electrically connecting a chip module 4 to a circuit board 5, and a method for manufacturing the shielded connector 100 includes the following steps.

S1: a body 1 is provided, wherein the body 1 has an upper surface 11 and a lower surface 12 which are oppositely arranged, and a plurality of signal accommodating holes 131 and ground accommodating holes 132. In other embodiments, the body 1 may have at least one signal accommodating hole 131 and at least one ground accommodating hole 132. For example, in one embodiment, only one signal accommodating hole 131 is provided. In an alternative embodiment, only one ground accommodating hole 132 is provided. The body 1 is further provided with a plurality of through holes 14 around each signal accommodating hole 131 and each ground accommodating hole 132 respectively. The signal accommodating holes 131, the ground accommodating holes 132 and the through holes 14 respectively pass through the upper surface 11 and the lower surface 12. A plurality of protruding blocks 15 are located on the upper surface 11. Each of the protruding blocks 15 includes a first protruding block 151 upwardly protruding from the upper surface 11 and a second protruding block 152 located on the first protruding block 151. (In other embodiments, each of the protruding blocks 15 can be in a one-piece shape instead of a two-piece shape.) A top surface of the second protruding block 152 is smaller than that of the first protruding block 151, and the top surface of the second protruding block 152 is used for supporting the chip module 4 and is an arc-shaped surface. (In other embodiments, the top surface of the second protruding block 152 can be a flat surface.) A side wall 16 upwardly protrudes from each of the four side edges of the upper surface 11 for stopping the chip module 4 from horizontally moving.

S2: the body 1 is placed in molten metal, so that the molten metal diffuses freely in the body 1 until the whole body 1 is covered, thereby plating the upper surface 11 and the lower surface 12 of the body 1, the inner walls of the signal accommodating holes 131, the inner walls of the ground accommodating holes 132, the inner walls of the through holes 14 and the surfaces of the protruding blocks 15 all with a metal layer 3.

S3: the metal layer 3 in the areas on the upper surface 11 and the lower surface 12 around the signal accommodating holes 131 and around the protruding blocks 15 are removed by a laser L so as to form an isolating region G around the signal accommodating holes 131 and an insulating region H around the protruding blocks 15. The isolating region G and the insulating region H are not provided with the metal layer 3, thereby dividing the metal layer 3 into a first metal layer 31 located outside the isolating region G, and a second metal layer 32 located inside the isolating region G. In the present embodiment, the isolating region G is communicated with the signal accommodating holes 131 so as to save the space of the upper surface 11. (In other embodiments, a gap can also be arranged between the isolating region G and the signal accommodating holes 131.) The through holes 14 are located outside the insulating region G. In other words, the upper surface 11, the lower surface 12, the inner walls of the ground accommodating holes 132 and the inner walls of the through holes 14 are provided with the first metal layer 31, and the inner walls of the signal accommodating holes 131 are provided with the second metal layer 32.

Figure 5:
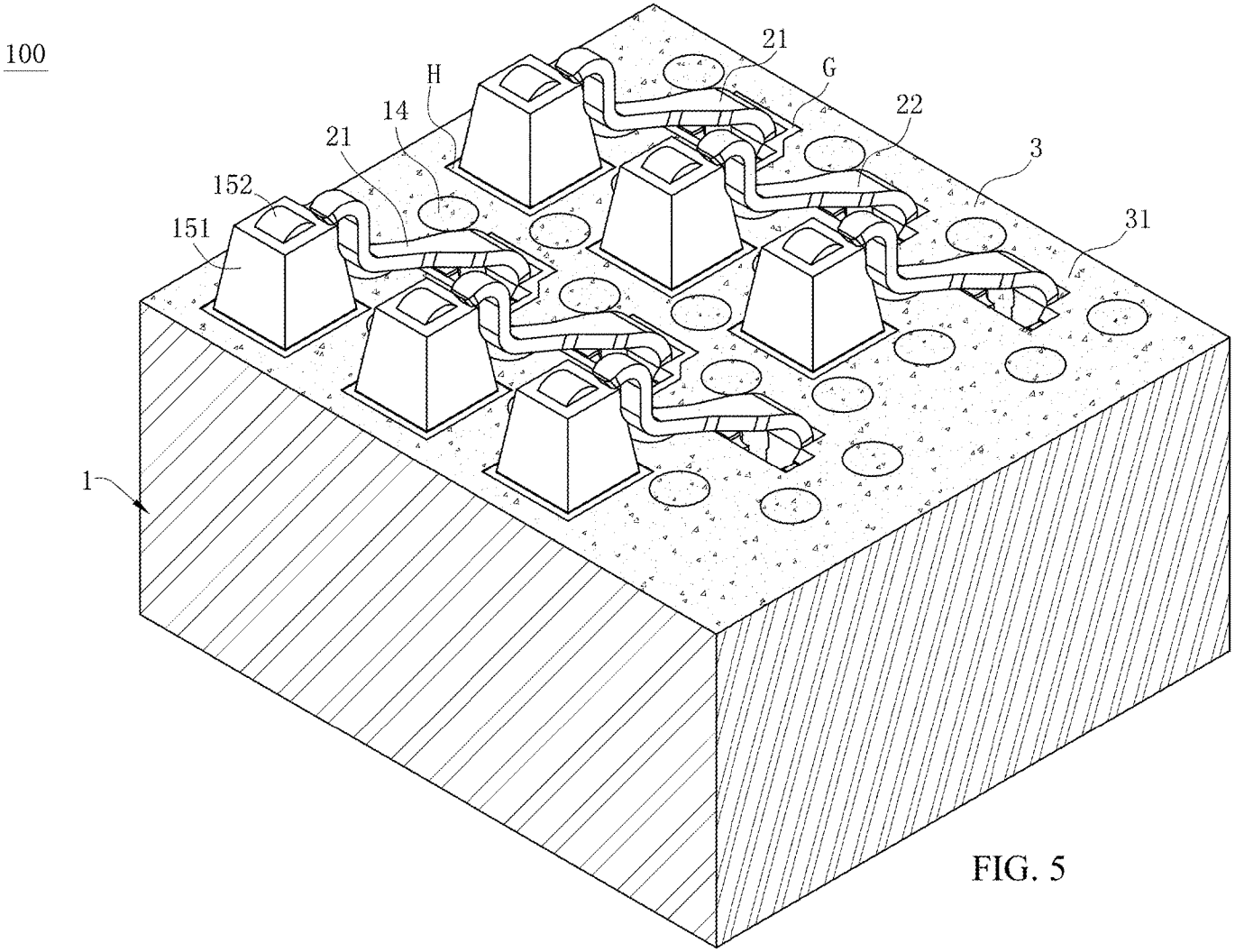
FIG. 5 is a local schematic view of FIG. 4.
Figure 6:
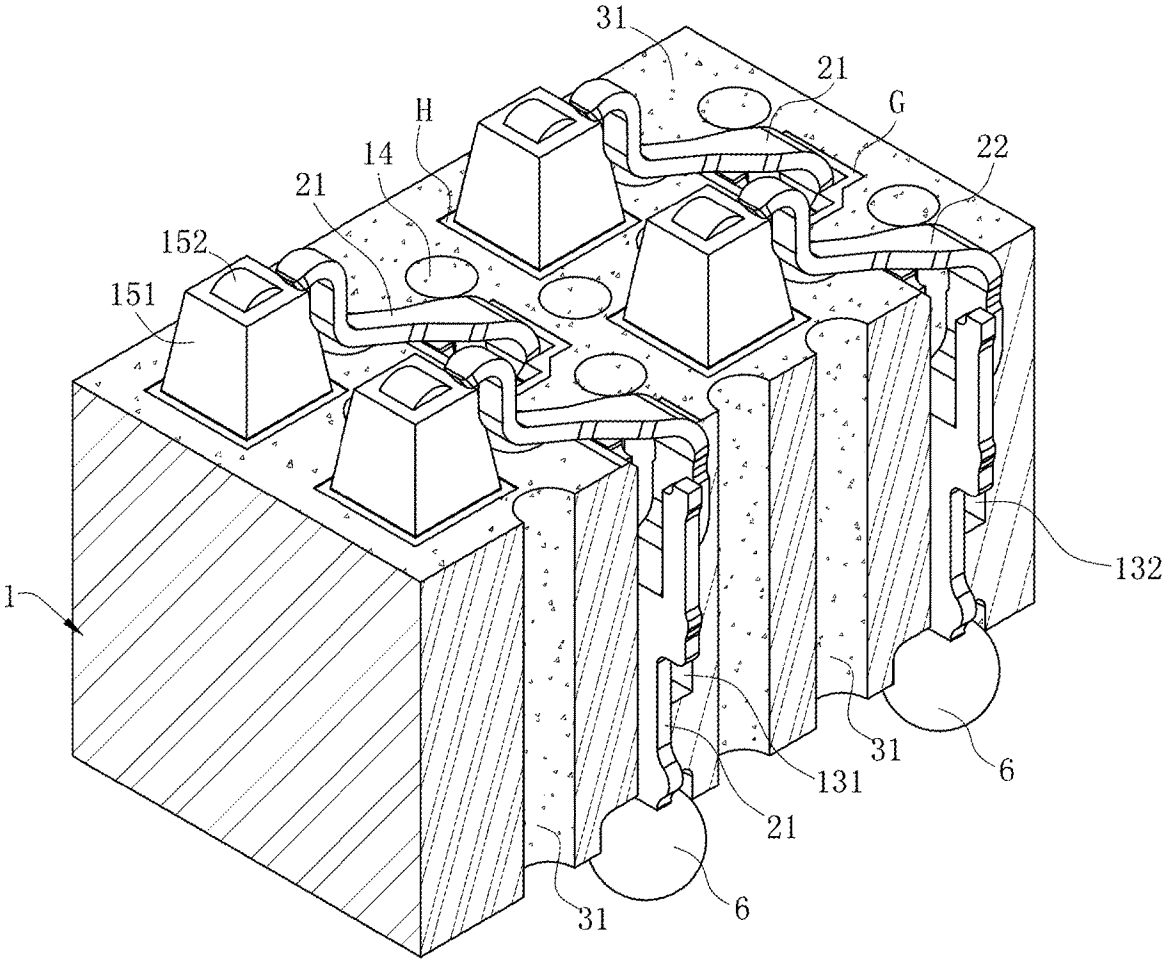
FIG. 6 is a local sectional view of FIG. 5.
Figure 7:
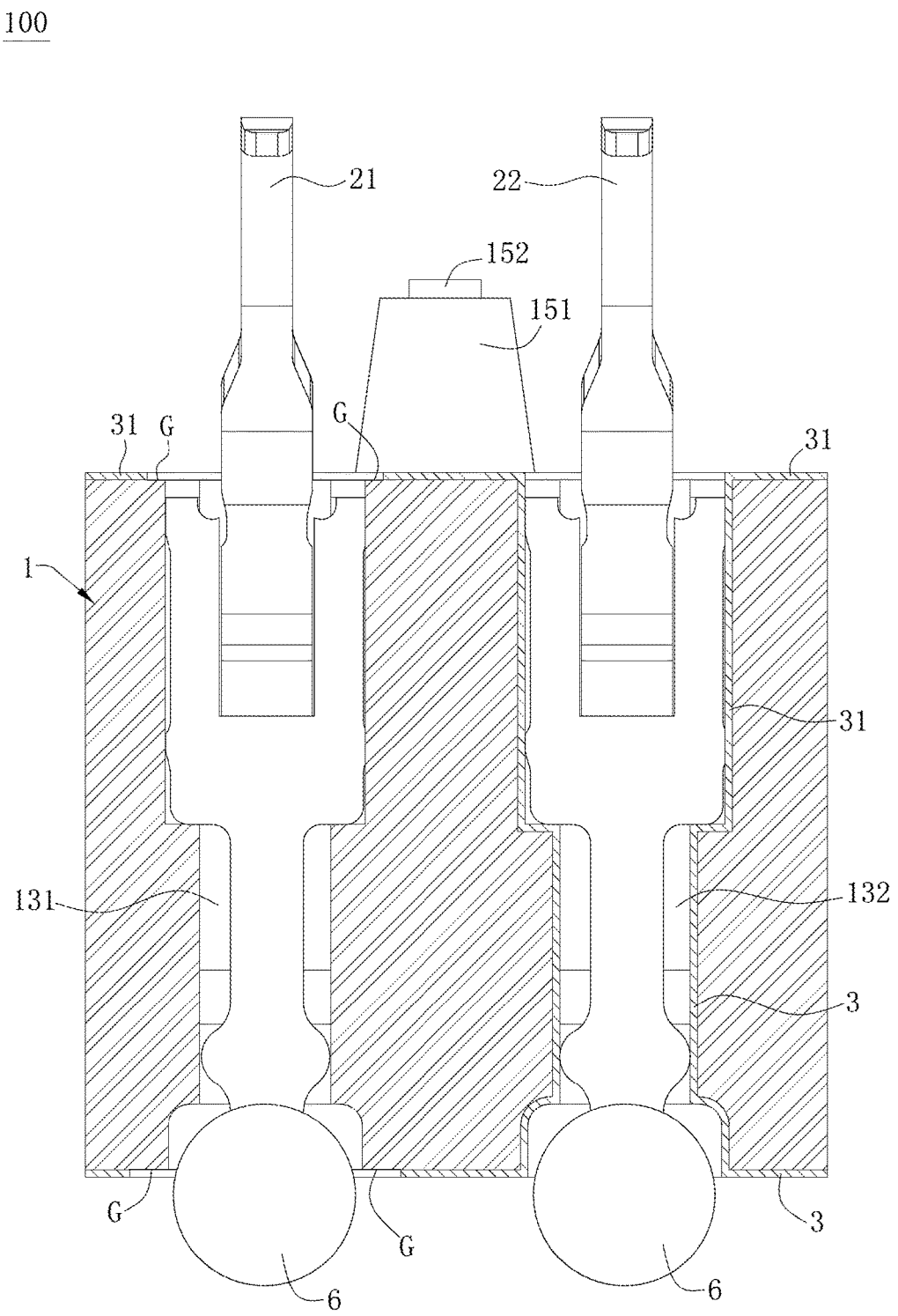
FIG. 7 is another schematic view of FIG. 6.
Figure 11:
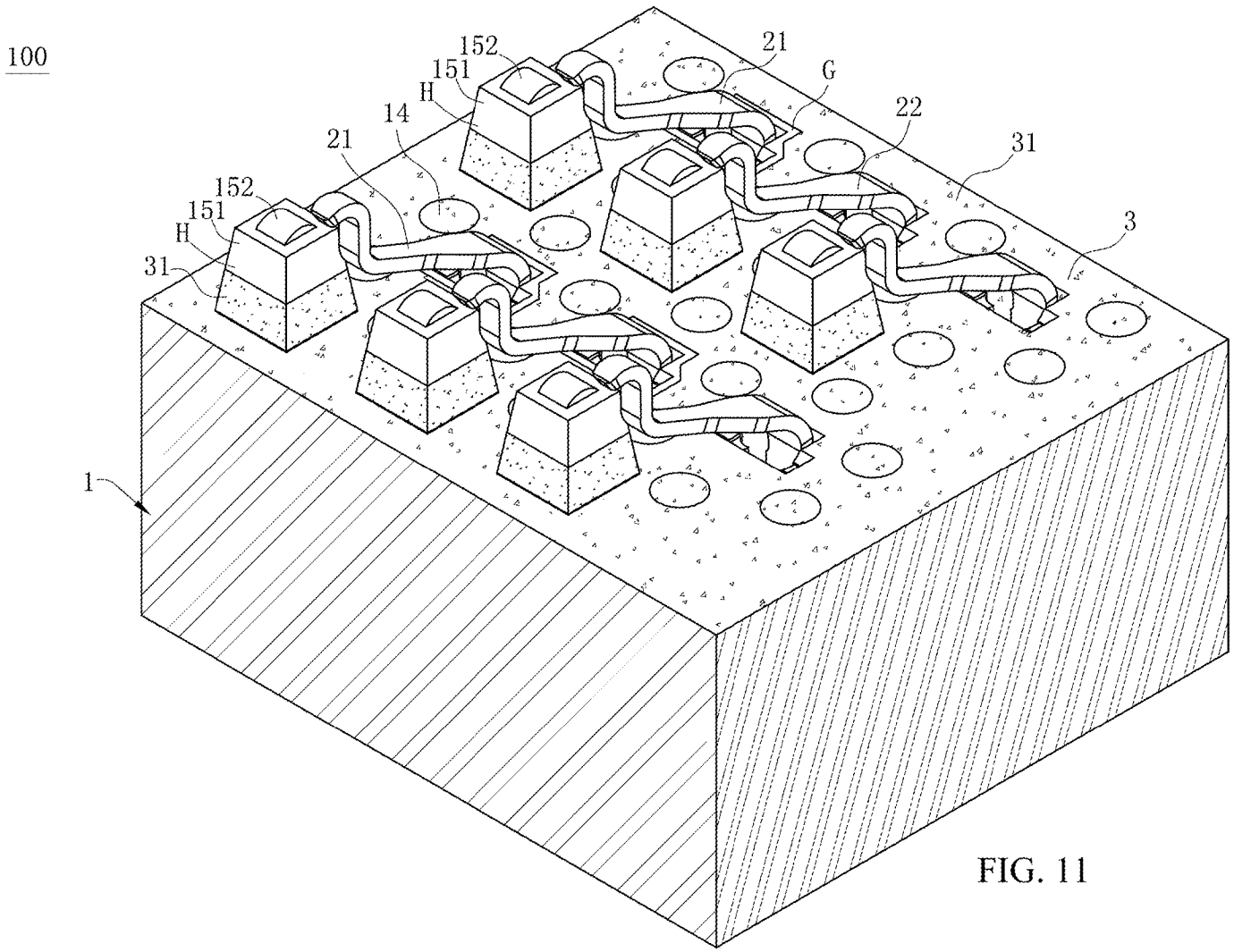
FIG. 11 is a schematic view according to an embodiment of the present invention, where laser irradiates the side of a first protruding block.
Figure 12:
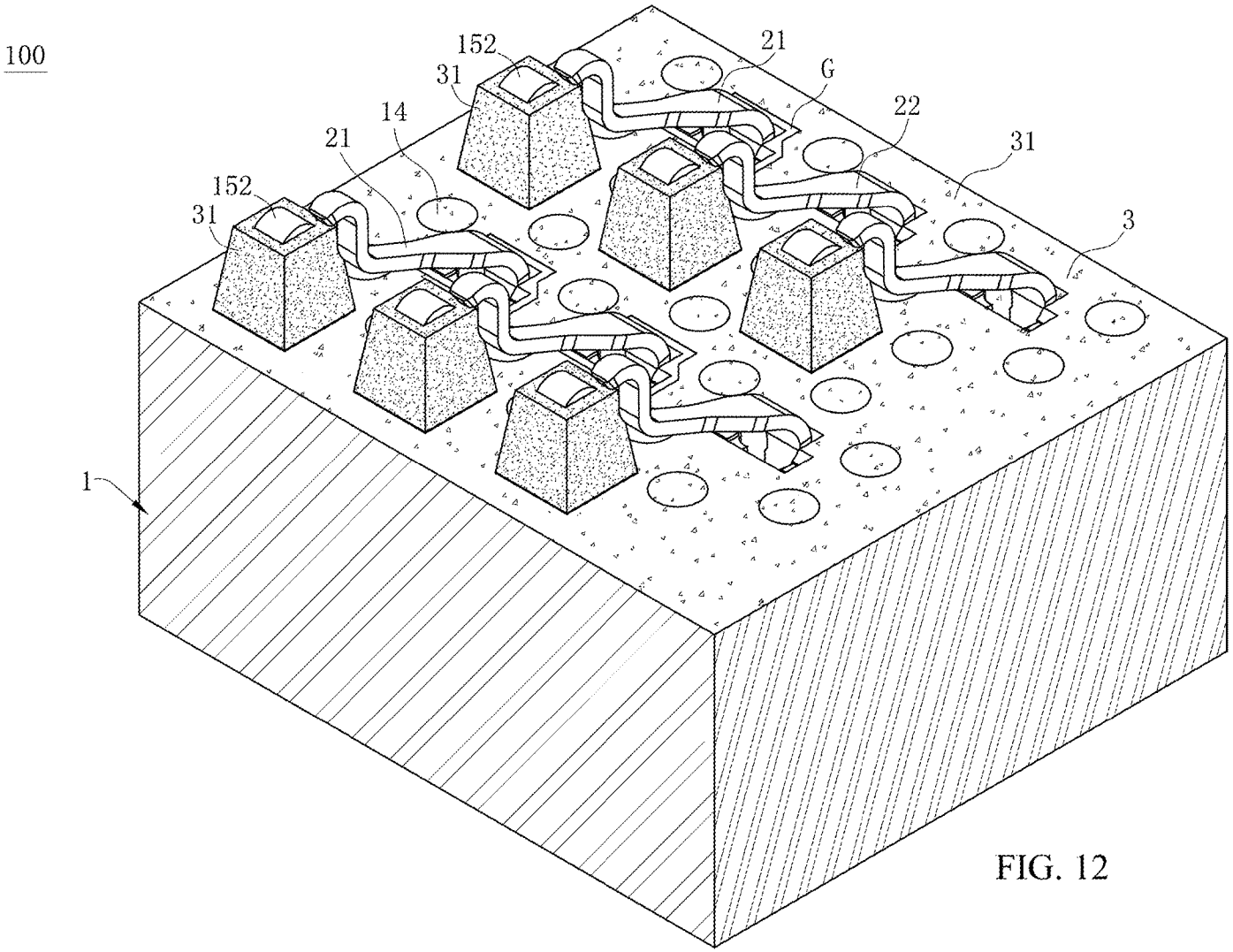
FIG. 12 is a schematic view according to an embodiment of the present invention, where laser irradiates the top surface of a second protruding block.

In step S3, there are many locations of the metal layer 3 around the protruding blocks 15 to be removed by laser L. As shown in FIG. 5, firstly, the metal layer 3 located at a joint area between the first protruding blocks 151 and the upper surface 11 is removed by laser L. As shown in FIG. 11, secondly, the metal layer 3 located in a surrounding area around the sides of the first protruding blocks 151 is removed by laser L. As shown in FIG. 12, the metal layer 3 on the top surface of the second protruding block 152 is removed by laser L.

S4: the first metal layer 31 of the upper surface 11 is electrified for an electroplating treatment so as to increase a thickness of the first metal layer 31 of the upper surface 11. The second metal layer 32 cannot be electrified because the second metal layer 32 is electrically disconnected from the first metal layer 31, so that the second metal layer 32 is not thickened. The first metal layer 31 on the inner walls of the ground accommodating holes 132 is also electrified so the thickness thereof is also increased.

During electroplating, one end of the first metal layer 31 is used as an anode in an electroplating solution, and the other end of the first metal layer 31 is used as a cathode. After power is turned on, cations in the electroplating solution are reduced on the surface of the first metal layer 31 to increase the thickness of the first metal layer 31. The second metal layer 32 cannot be electrified because the second metal layer 32 is electrically disconnected from the first metal layer 31, so that the thickness of the second metal layer 32 is not changed.

S5: a part of the metal layer 3 is removed by a thickness of the second metal layer, so as to completely remove the second metal layer 32. In other words, the second metal layer 32 located on the inner walls of the signal accommodating holes 131 is completely gone. The thickness of the first metal layer 31 located on the upper surface 11 and the first metal layer 31 located on the inner walls of the ground accommodating holes 132 are decreased.

Specifically, the body 1 is placed in a chemical solution. The chemical solution is an acid solution, and the metal layer 3 is immersed in the chemical solution. The metal layer 3 is partially removed by the thickness of the second metal layer 32 by controlling the concentration of the chemical solution and the immersion time of the body 1, so that the second metal layer 32 is completely removed, and the thickness of the first metal layer 31 is decreased.

S6: a plurality of signal terminals 21 and a plurality of ground terminals 22 are provided and correspondingly installed in the signal accommodating holes 131 and the ground accommodating holes 132, respectively, for elastically upwardly abutting the chip module 4, and are soldered onto the circuit board 5 through solder balls 6. In other embodiments, the quantities of the signal terminals 21 and the ground terminals 22 are correspond to the quantities of the signal accommodating holes 131 and the ground accommodating holes 132, respectively. For example, in one embodiment, when only one signal accommodating hole 131 is provided, only one signal terminal 21 may be provided and correspondingly installed in the only one signal accommodating hole 131. In an alternative embodiment, when only one ground accommodating hole 132 is provided, only one ground terminal 22 may be provided and correspondingly installed in the only one ground accommodating hole 132.

Figure 8:
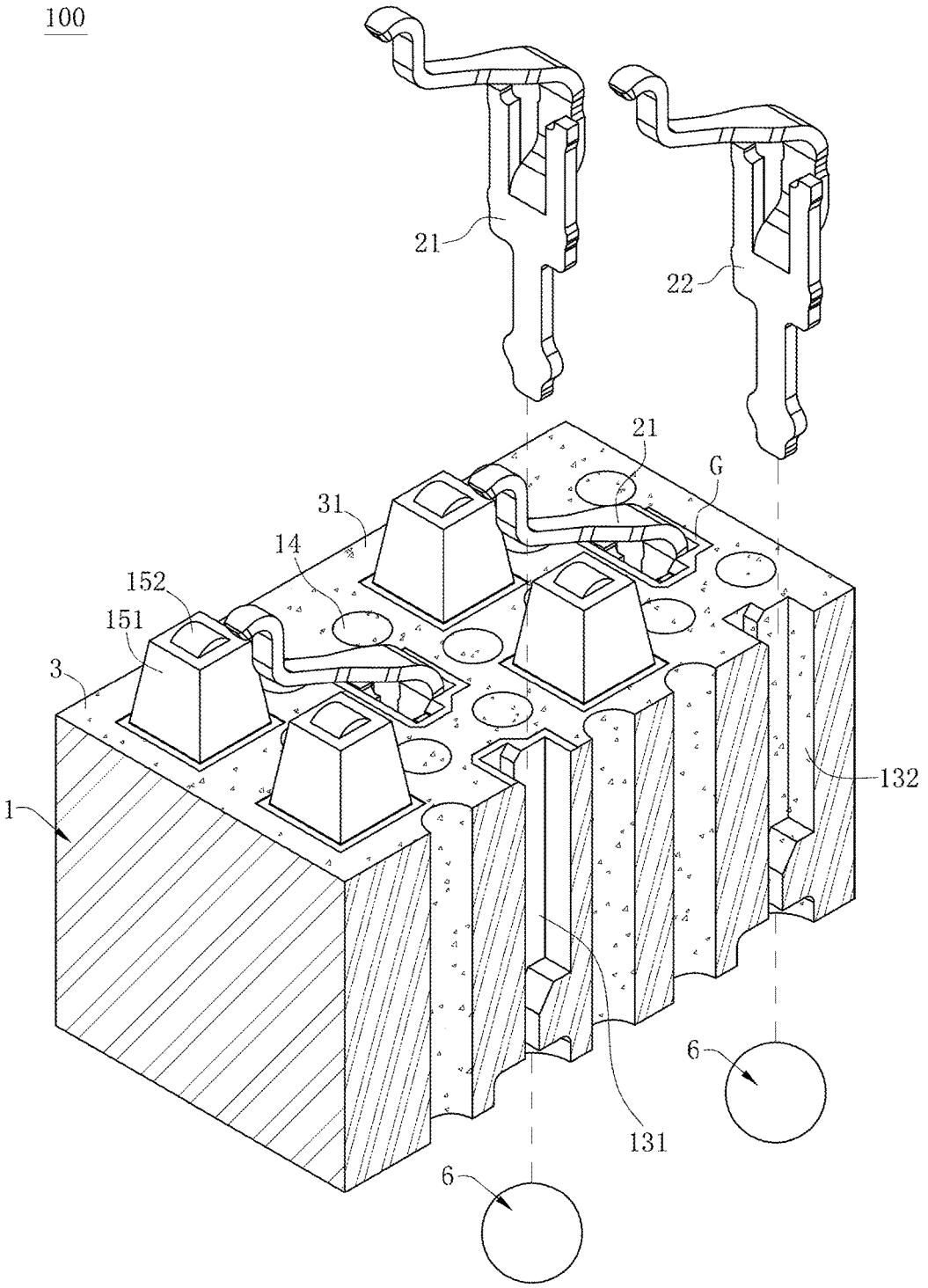
FIG. 8 is a schematic view obtained before signal terminals and ground terminals are assembled on a body in FIG. 6.
Figure 9:
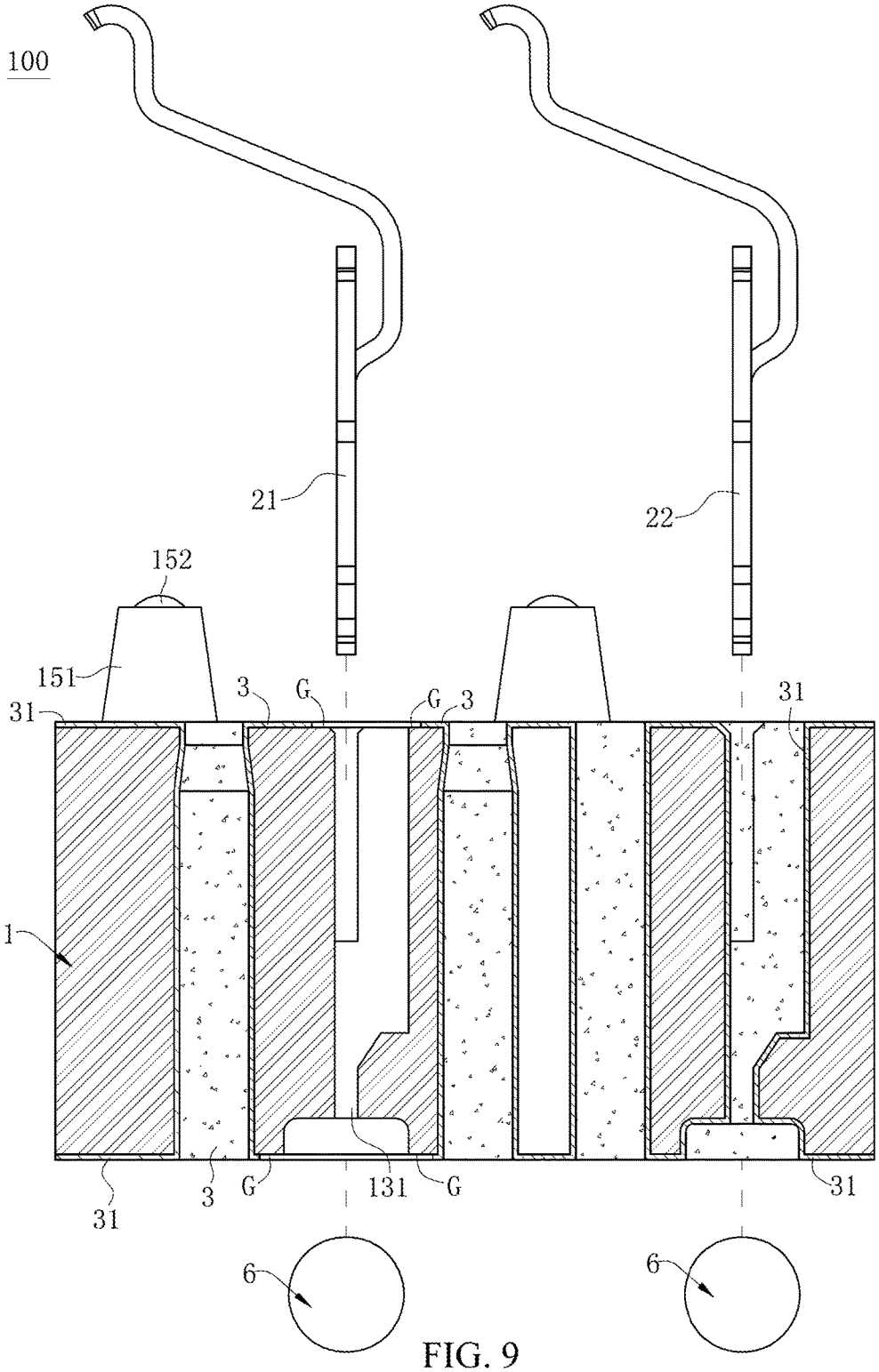
FIG. 9 is another schematic view of FIG. 8.

As shown in FIG. 1 and FIG. 8, the signal terminals 21 and the ground terminals 22 have same structures. The ground terminals 22 abut the first metal layer 31 on the inner walls of the ground accommodating holes 132, thereby shielding the signal interference between the signal terminals 21 to meet the transmission of high-frequency signals of the signal terminals 21.

Figure 13:
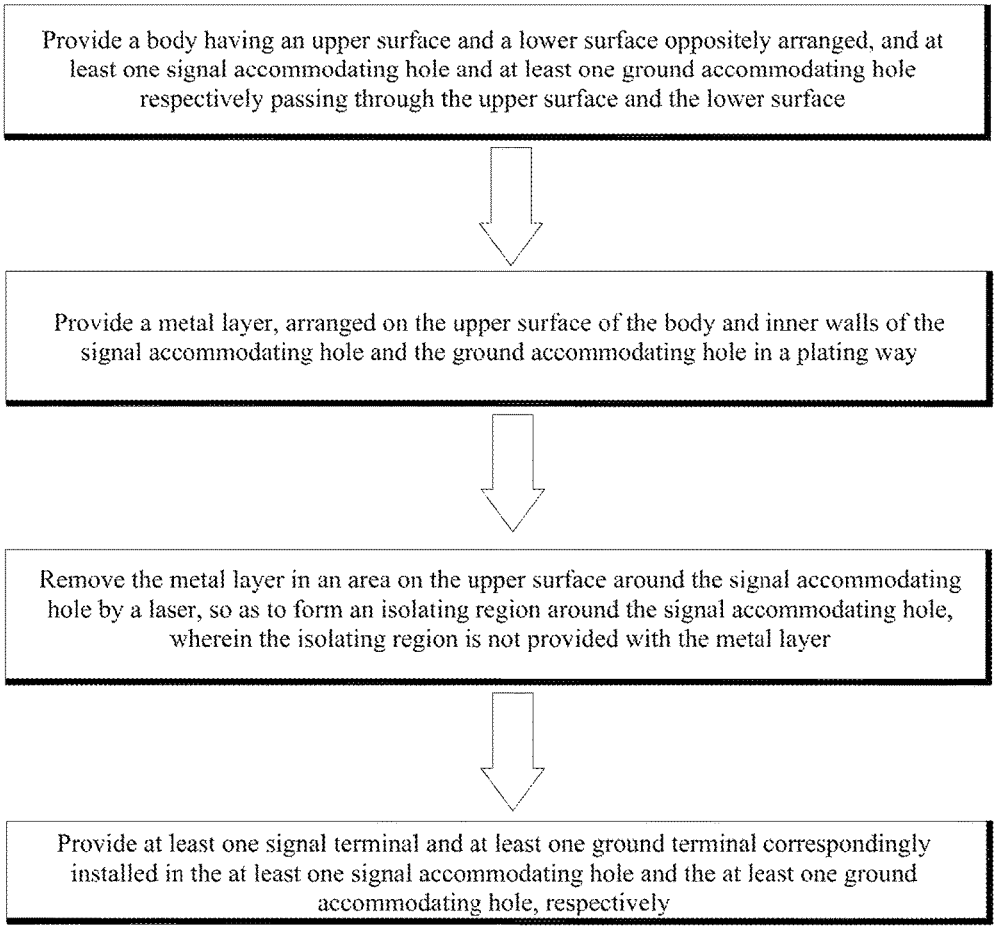
FIG. 13 is a flowchart of a method for manufacturing a shielded connector according to another embodiment of the present invention.
Figure 14:
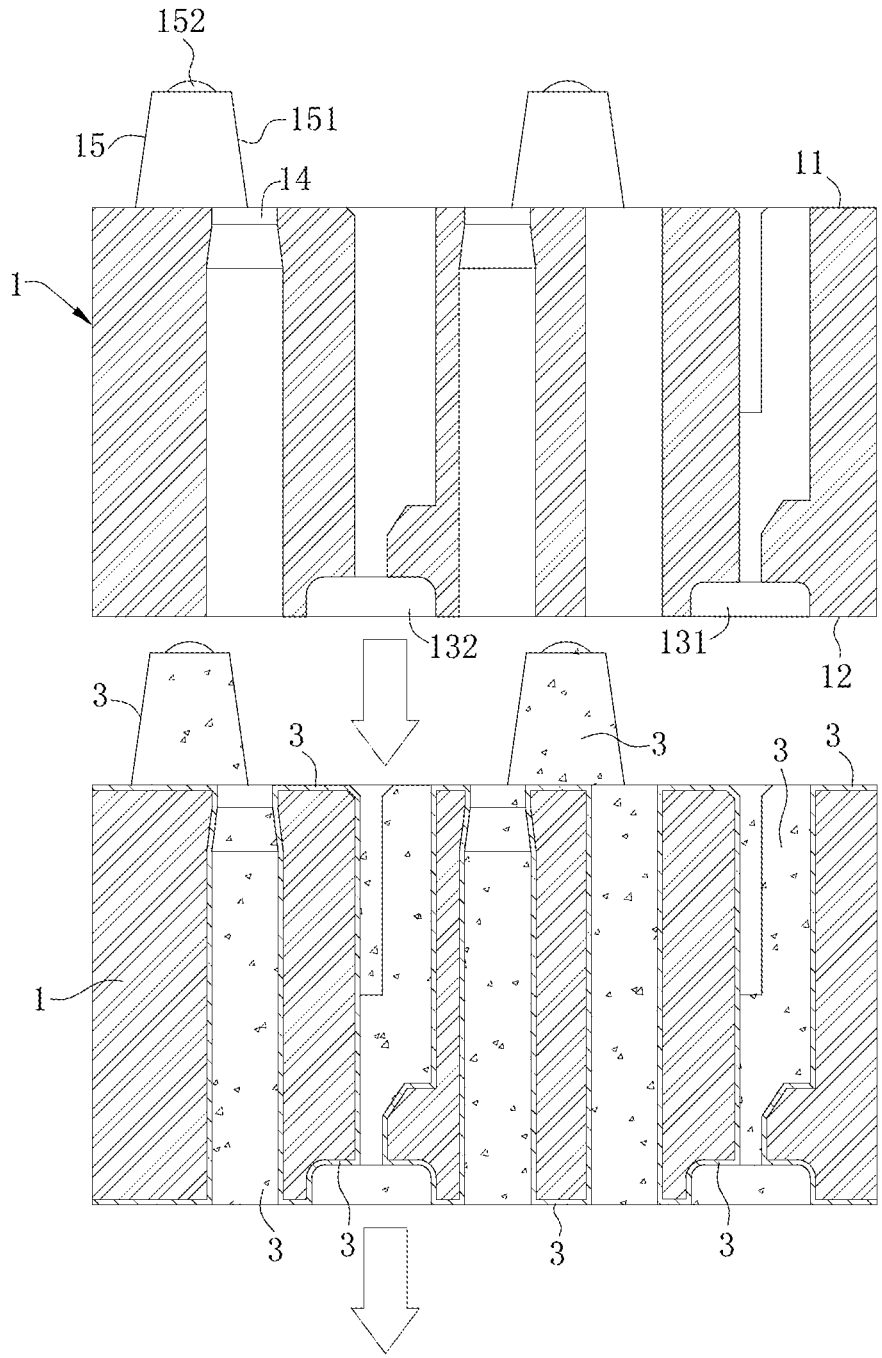
FIG. 14 is a structural schematic view of the shielded connector manufactured by the method in FIG. 13.
Figure 15:
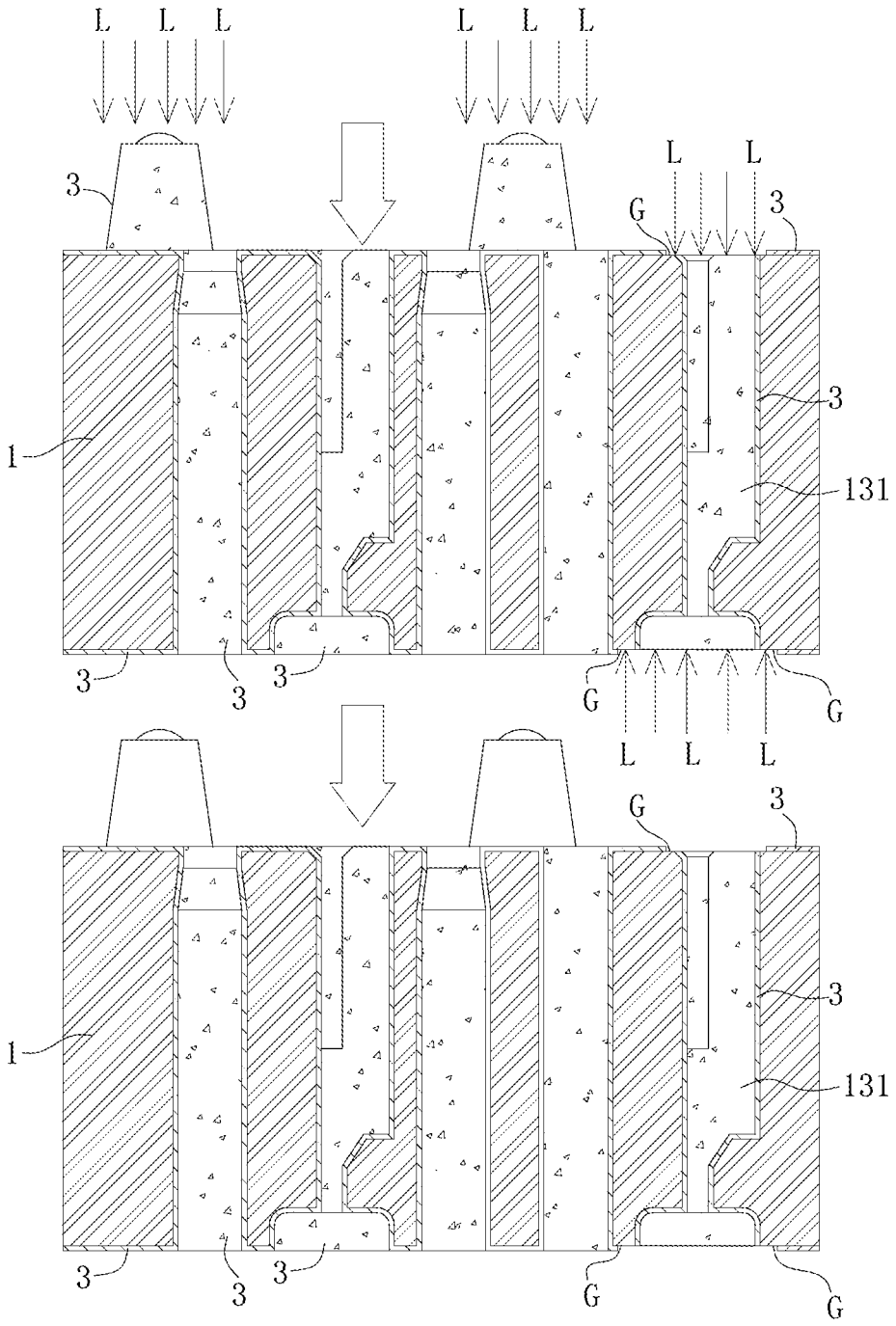
FIG. 15 is a structural schematic view of the shielded connector manufactured by the method in FIG. 13.

As shown in FIG. 13 to FIG. 15, a method for manufacturing the shielded connector 100 is provided. The difference of this method from the above-mentioned manufacturing method exists in that step S4 and step S5 are omitted, so that the second metal layer 32 is still arranged inside the signal accommodating holes 131 when the signal terminals 21 and the ground terminals 22 are respectively and correspondingly installed in the signal accommodating holes 131 and the ground accommodating holes 132. In order to avoid a short circuiting occurs to the chip module 4 due to the chip module 4 being in contact with the metal layer 3 located on the top surface of the protruding block 15, the metal layer 3 located on the top surface of the protruding block 15 can be directly removed by the laser L. The metal layer 3 located on the side of the protruding blocks 15 can be simultaneously removed so as to avoid short circuiting occurs to the signal terminals 21 due to the signal terminal 21 being in contact with the metal layer 3 located on the side of the protruding block 15.

Figure 4:
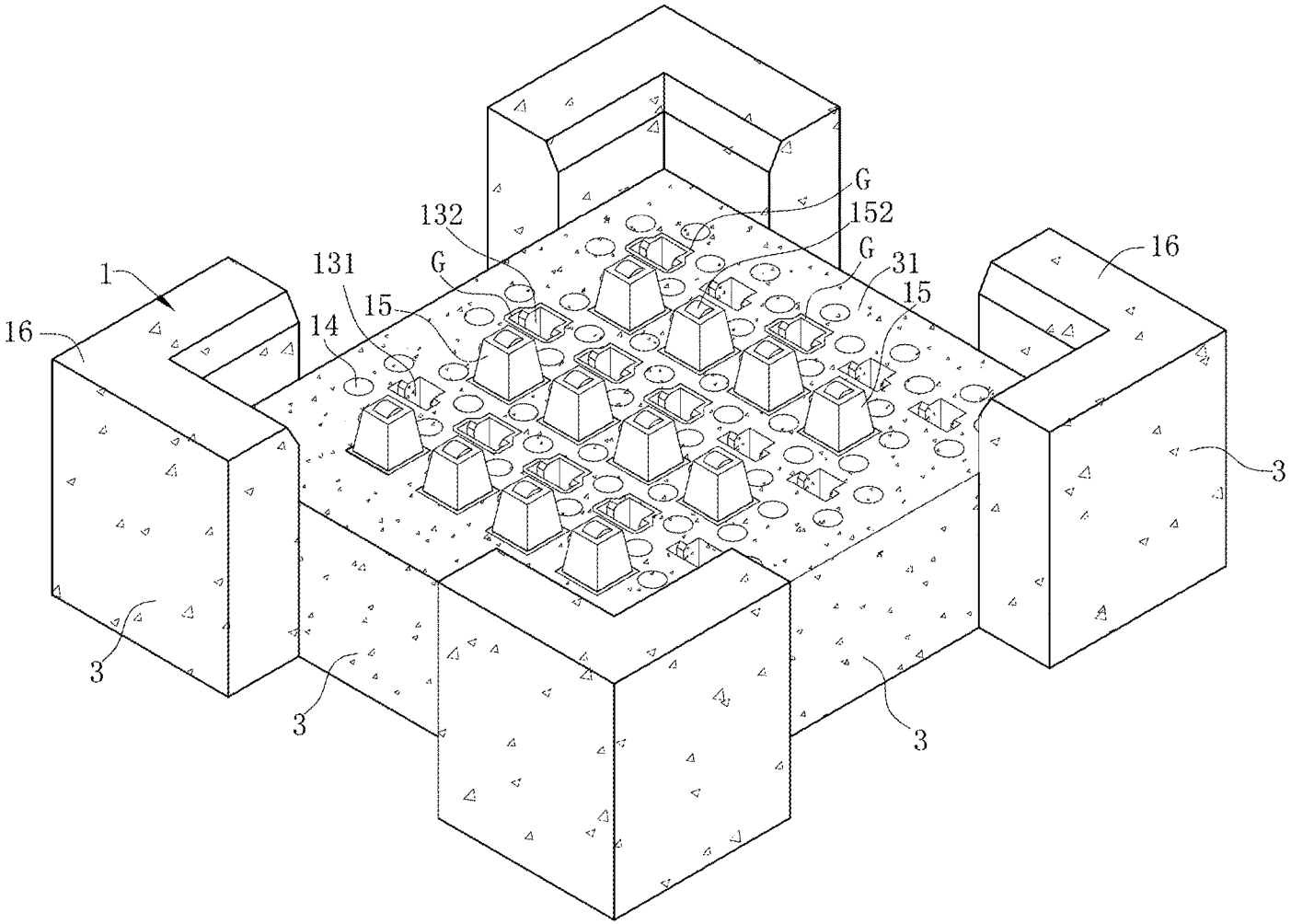
FIG. 4 is a three-dimensional schematic view of the shielded connector according to a first embodiment of the present invention.
Figure 10:
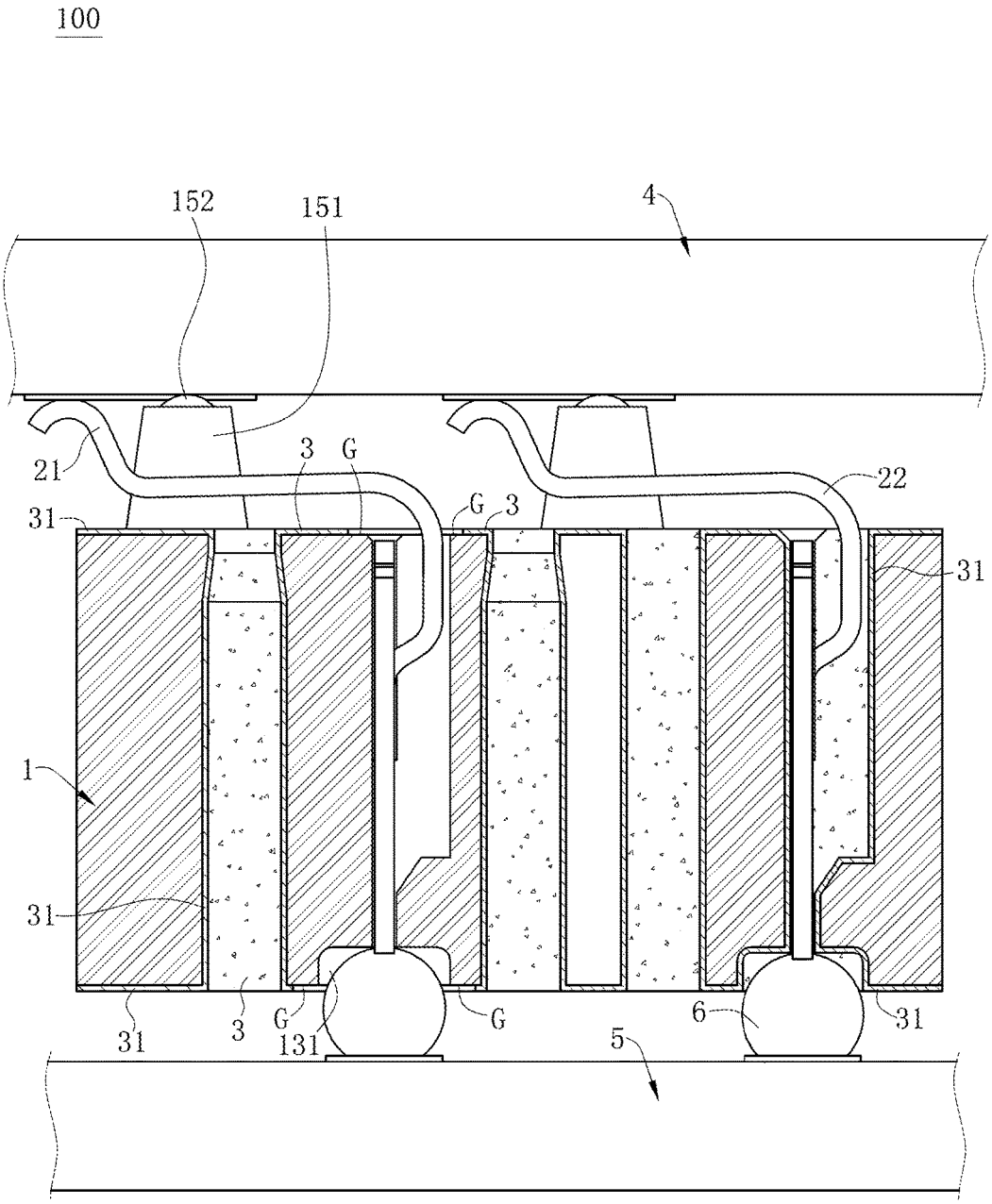
FIG. 10 is a schematic view obtained after a chip module is pressed down in FIG. 9.

As shown in FIG. 4 and FIG. 10, the top surface of the second protruding block 152 is not provided with the metal layer 3 so as to prevent the metal layer 3 from being in contact with the chip module 4 and prevent the chip module 4 from short circuiting.

Figure 16:
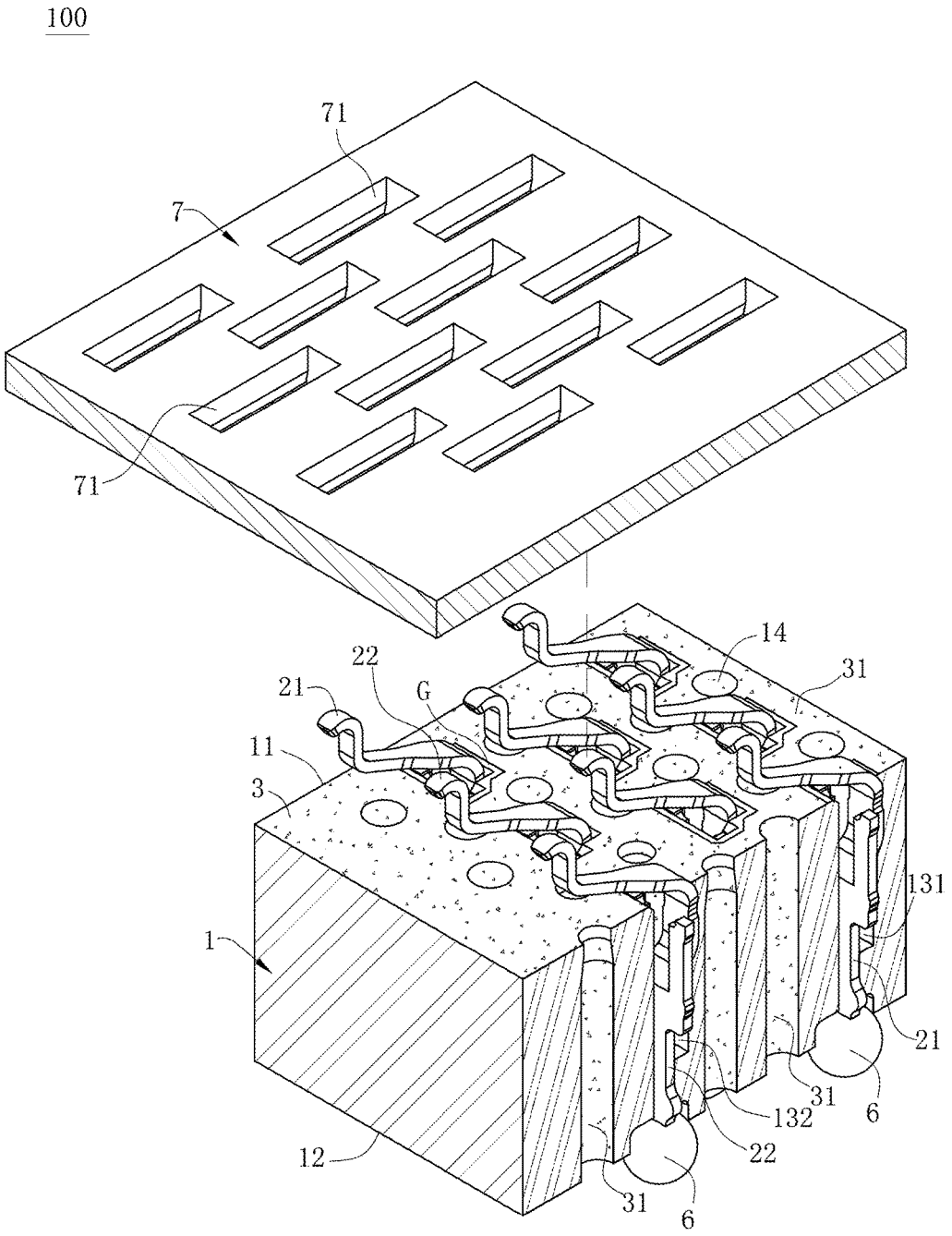
FIG. 16 is a three-dimensional schematic view of the shielded connector according to a second embodiment of the present invention.
Figure 17:
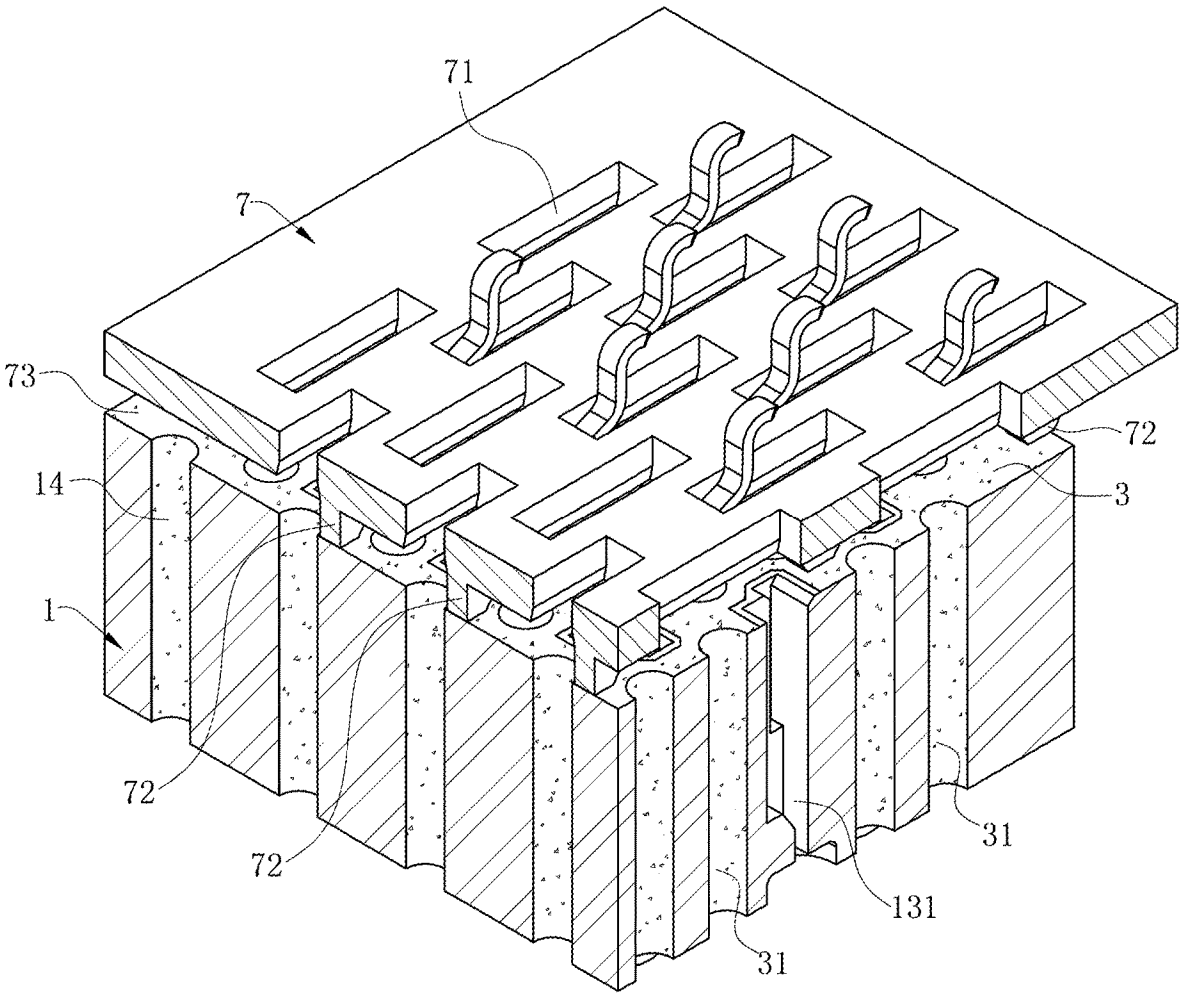
FIG. 17 is a schematic view where a supporting cover is arranged on the body in a supporting way in FIG. 16.

As shown in FIG. 16 to FIG. 17, the shielded connector 100 according to a second embodiment of the present invention is provided. The difference between this embodiment and the first embodiment exists in that the body 1 is not provided with the protruding blocks 15, but a supporting cover 7 is arranged on the body 1 for supporting the chip module 4. The supporting cover 7 is provided with a plurality of through slots 71 for the signal terminals 21 and the ground terminals 22 to respectively pass therethrough respectively, and a plurality of supporting blocks 72 downwardly protrude from the bottom surface of the supporting cover 7. When the chip module 4 abuts the signal terminals 21 and the ground terminals 22, the supporting blocks 72 are supported on the upper surface 11 and located between the two adjacent through holes 14. A gap 73 is arranged between the bottom surface of the supporting cover 7 and the upper surface 11, and the gap 73 provides a deformation space for the signal terminals 21 and the ground terminals 22, thereby preventing the signal terminals 21 and the ground terminals 22 from being crushed in the assembly process of the chip module 4, and providing a larger dissipation space between the supporting cover 7 and the body 1, so that a lot of heat generated by the chip module 4 in operation can be rapidly dissipated, and thus improving the operational stability of the chip module 4. The manufacturing method thereof can be referred to the related description of the first embodiment, and the description thereof will not be elaborated herein.

In sum, the method for manufacturing the shielded connector according to certain embodiments of the present invention has the following beneficial effects:

(1) The metal layer 3 in an area on the upper surface 11 around the signal accommodating holes 131 is removed by the laser L, so as to form an isolating region G on the upper surface 11 around the signal accommodating holes 131, which can be realized without ensuring that the upper surface 11 is a flat surface, thus facilitating the manufacturing of the body 1. The first metal layer 31 is electrified for electroplating to increase its thickness, and the metal layer 3 is partially removed by the thickness of the second metal layer 32, so that the second metal layer 32 is completely removed and the body 1 still has the first metal layer 31, thus ensuring the good shielding effect of the shielded connector 100.

(2) The body 1 is provided with a plurality of through holes 14 passing through the lower surface 12 from the upper surface 11. The through holes 14 are arranged around each signal accommodating hole 131 and each ground accommodating hole 132 respectively, and the metal layer 3 is arranged on the inner walls of the through holes 14 in a plating way, thereby forming surroundingly a three-dimensional shielding space to isolate the signal terminals 21 and avoiding the mutual interference between the signal terminals 21.

(3) In step S3, the metal layer 3 located at the joint area of the first protruding blocks 151 and the upper surface 11 is removed by laser L. After step S4 and step S5 are performed, the metal layer 3 located on the side surfaces and the top surfaces of the first protruding blocks 151 can be completely removed, thereby preventing short circuiting occurs to the chip module 4 due to the chip module 4 being in contact with the metal layer 3 located on the top surfaces of the first protruding blocks 151, and preventing short circuiting occurs to the signal terminals 21 due to the signal terminals 21 being in contact with the metal layer 3 located on the sides of the first protruding blocks 151.

(4) In step S3, the metal layer 3 located on the sides of the first protruding blocks 151 is removed by laser L so as to form an insulating region H around the first protruding blocks 151. After step S4 and step S5 are performed, the metal layer 3 located above the insulating region H does not exist, therefore preventing short circuiting occurs to the chip module 4 due to the chip module 4 being in contact with the metal layer 3 located on the top surfaces of the second protruding blocks 152, and saving the space of the upper surface 11.

(5) The supporting cover 7 is arranged on the body 1 for supporting the chip module 4. The supporting cover 7 is protrudingly provided with the supporting blocks 72 to be supported on the upper surface 11 and located between the two adjacent through holes 14, thereby preventing that a gap between the two adjacent through holes 14 is not large enough to form the protruding block 15.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A method for manufacturing a shielded connector, the method comprising the following steps:

S1: providing a body, having an upper surface and a lower surface which are oppositely arranged, and at least one signal accommodating hole and at least one ground accommodating hole respectively passing through the upper surface and the lower surface;

S2: providing a metal layer, arranged on the upper surface of the body and inner walls of the at least one signal accommodating hole and the at least one ground accommodating hole in a plating way;

S3: removing the metal layer in an area on the upper surface around the at least one signal accommodating hole by a laser, so as to form an isolating region in the area on the upper surface around the at least one signal accommodating hole, wherein the isolating region is not provided with the metal layer, and divides the metal layer into a first metal layer located outside the isolating region and a second metal layer located inside the isolating region;

S4: electrifying the first metal layer on the upper surface for an electroplating treatment so as to increase a thickness of the first metal layer on the upper surface, wherein the second metal layer is electrically disconnected from the first metal layer and is not electrified, so that the second metal layer is not thickened;

S5: removing a part of the metal layer by a thickness of the second metal layer, so as to completely remove the second metal layer and decrease the thickness of the first metal layer; and S6: providing at least one signal terminal and at least one ground terminal, wherein the at least one signal terminal and the at least one ground terminal are correspondingly installed in the at least one signal accommodating hole and the at least one ground accommodating hole, respectively, for conductively connecting to a chip module.

2. The method according to claim 1, wherein the body is further provided with a plurality of through holes around each of the at least one signal accommodating hole and each of the at least one ground accommodating hole respectively, the through holes pass through the upper surface and the lower surface, the isolating region is communicated with the at least one signal accommodating hole, and the through holes are located outside the isolating region.

3. The method according to claim 2, further comprising:

after the step S6 is performed, arranging a supporting cover on the body for supporting the chip module, wherein:

the supporting cover is provided with a plurality of through slots for the at least one signal terminal and the at least one ground terminal to pass therethrough respectively;

a plurality of supporting blocks downwardly protrude from a bottom surface of the supporting cover; and when the chip module abuts the at least one signal terminal and the at least one ground terminal, the supporting blocks are supported on the upper surface and located between two adjacent through holes.

4. The method according to claim 1, wherein a plurality of protruding blocks are located on the upper surface for supporting the chip module; and in the step S2, the metal layer is also arranged on surfaces of the protruding blocks in the plating way.

5. The method according to claim 4, wherein the step S3 further comprises removing the metal layer in an area around the protruding blocks by the laser.

6. The method according to claim 5, wherein the step S3 further comprises removing the metal layer located at a joint area between the protruding blocks and the upper surface by the laser.

7. The method according to claim 5, wherein the step S3 further comprises removing the metal layer located in a surrounding area on side walls of the protruding blocks by the laser.

8. The method according to claim 4, wherein the step S3 further comprises removing the metal layer on top surfaces of the protruding blocks by the laser.

9. The method according to claim 8, wherein the protruding blocks comprise a first protruding block upwardly extending from the upper surface and a second protruding block located on the first protruding block, the top surface of the second protruding block is smaller than that of the first protruding block, and the top surface of the second protruding block is for supporting the chip module; and the step S3 further comprises removing the metal layer located on the top surface of the second protruding block by the laser.

10. The method according to claim 1, wherein a side wall upwardly protrudes from each of the four side edges of the upper surface for stopping the chip module from horizontally moving.

11. A method for manufacturing a shielded connector, the method comprising the following steps:

S1: providing a body, having an upper surface and a lower surface which are oppositely arranged, and at least one signal accommodating hole and at least one ground accommodating hole respectively passing through the upper surface and the lower surface;

S2: providing a metal layer, arranged on the upper surface of the body and inner walls of the at least one signal accommodating hole and the at least one ground accommodating hole in a plating way;

S3: removing the metal layer in an area on the upper surface around the at least one signal accommodating hole by a laser, so as to form an isolating region in the area on the upper surface around the at least one signal accommodating hole, wherein the isolating region is not provided with the metal layer; and S4: providing at least one signal terminal and at least one ground terminal, wherein the at least one signal terminal and the at least one ground terminal are correspondingly installed in the at least one signal accommodating hole and the at least one ground accommodating hole, respectively.

12. The method according to claim 11, wherein the body is further provided with a plurality of through holes around each of the at least one signal accommodating hole and each of the at least one ground accommodating hole respectively, the through holes pass through the upper surface and the lower surface, the isolating region is communicated with the at least one signal accommodating hole, and the through holes are located outside the isolating region.

13. The method according to claim 12, further comprising:

arranging a supporting cover on the body for supporting the chip module, wherein:

the supporting cover is provided with a plurality of through slots for the at least one signal terminal and the at least one ground terminal to pass therethrough respectively;

a plurality of supporting blocks downwardly protrude from a bottom surface of the supporting cover; and when the chip module abuts the at least one signal terminal and the at least one ground terminal, the supporting blocks are supported on the upper surface and located between two adjacent through holes.

14. The method according to claim 11, wherein a plurality of protruding blocks are located on the upper surface for supporting the chip module; and in the step S2, the metal layer is also arranged on surfaces of the protruding blocks in the plating way.

15. The method according to claim 14, wherein the step S3 further comprises removing the metal layer on top surfaces of the protruding blocks by the laser.

16. The method according to claim 15, wherein the protruding blocks comprise a first protruding block upwardly extending from the upper surface and a second protruding block located on the first protruding block, the top surface of the second protruding block is smaller than that of the first protruding block, and the top surface of the second protruding block is for supporting the chip module; and the step S3 further comprises removing the metal layer located on the top surface of the second protruding block by the laser.

17. The method according to claim 16, wherein the top surface of the second protruding block is an arc-shaped surface.

18. The method according to claim 11, wherein the at least one ground terminal and the at least one signal terminal have same structures; and after step S4 is performed, the inner walls of the at least one signal accommodating hole and the at least one ground accommodating hole are both provided with the metal layer.

19. The method according to claim 11, wherein a side wall upwardly protrudes from each of the four side edges of the upper surface for stopping the chip module from horizontally moving.

* * * * *